US006673164B2

(12) United States Patent
Rasouli et al.

(10) Patent No.: US 6,673,164 B2
(45) Date of Patent: Jan. 6, 2004

(54) METHOD OF MINIMIZING ENVIRONMENTAL EFFECT IN ALUMINIDES

(75) Inventors: Firooz Rasouli, Midlothian, VA (US); Clive R. Scorey, Cheshire, CT (US)

(73) Assignee: Philip Morris Incorporated, New York, NY (US)

( * ) Notice: Subject to any disclaimer, the term of this patent is extended or adjusted under 35 U.S.C. 154(b) by 179 days.

(21) Appl. No.: 09/951,678

(22) Filed: Sep. 14, 2001

(65) Prior Publication Data

US 2002/0057983 A1 May 16, 2002

Related U.S. Application Data

(60) Provisional application No. 60/233,495, filed on Sep. 19, 2000.

(51) Int. Cl.[7] ..... C23C 22/00

(52) U.S. Cl. ..... 148/243; 148/246; 148/274; 148/708; 427/156; 427/435; 29/611; 72/41; 72/42; 72/46

(58) Field of Search ..... 148/240, 243, 148/246, 274, 708; 427/156, 435; 29/611; 72/41, 42, 46

(56) References Cited

U.S. PATENT DOCUMENTS

| | | | |
|---|---|---|---|
| 3,222,778 | A | 12/1965 | Ida |
| 3,969,195 | A | 7/1976 | Dötzer et al. |
| 5,312,580 | A | 5/1994 | Erickson et al. |
| 5,620,651 | A | 4/1997 | Sikka et al. |
| 5,976,458 | A | 11/1999 | Sikka et al. |
| 6,030,472 | A | 2/2000 | Hajaligol et al. |

OTHER PUBLICATIONS

N.S. Stoloff et al., "Physical Metallurgy and Processing of Intermetallic Compounds" pp. 479–516, 1996, Chapman & Hall, New York, NY, (no month data).

C.G. McKamey, "Iron Aluminides", Physical Metallurgy and Processing of Intermetallic Compounds pp. 351–391, Chapter 9, 1996, Chapman & Hall, New York, NY., (no month data).

Elliot S. Nachtman, "Selection and Use of Lubricants in Forming of Sheet Metal", pp. 512–520, Metals Handbook Ninth Edition, vol. 14 Forming and Forging, Metals Park, OH, (no date).

C.T. Liu, "High–Temperature Ordered Intermetallic Alloys V", Nov. 30–Dec. 3, 1992, Boston, MA, Recent Advances in Ordered Intermetallics, Mat. Res. Soc. Symp. Proc. vol. 288., pp. 3–19, 1993 Materials Research Society., (no month data).

R.E. Mistler et al., "Tape Casting as a Fabrication Process for Iron Aluminide (FeA1) Thin Sheet", Materials Science and Engineering, vol. A258, Elsevier, New York, NY, 1998, pp. 258–265., (no month data).

F. Rasouli et al., "Tape Casting of Iron Aluminide Powders", Procd. Internationl Conference on Powder Metallurgy & Particulate Materials, Vol 9, Metal Powder Industries Federation, New York, NY, 2000 pp. 131–140., (no month data).

Written Opinion for PCT/US01/28638 dated Jul. 19, 2002.

*Primary Examiner*—John Sheehan
*Assistant Examiner*—Andrew L. Oltmans
(74) *Attorney, Agent, or Firm*—Burns, Doane, Swecker & Mathis, LLP

(57) ABSTRACT

A method of cold fabricating an intermetallic alloy composition, comprising steps of coating an article of an intermetallic alloy composition with a viscous medium which provides a moisture resistant barrier on the surface of the article, fabricating the coated article into a desired shape, and optionally removing the coating from the shaped article. The coating step can be carried out by applying oil to the surface of the article or immersing the article in oil. The intermetallic article can be an iron aluminide and the fabrication step can include stamping, bending, drawing, forming, cutting, shearing or punching. During the fabrication step a surface oxide film is cracked and metal surfaces exposed by the cracked oxide film are protected from exposure to moisture in the air by the viscous medium.

22 Claims, 5 Drawing Sheets

METHOD OF MINIMIZING ENVIRONMENTAL EFFECT IN ALUMINIDES

This application claims priority under 35 U.S.C. §§119 and/or 365 to Provisional Application No. 60/233,495 filed in U.S.A. on Sep. 19, 2000; the entire content of which is hereby incorporated by reference.

BACKGROUND

Field of the Invention

The present invention is directed to a method to process an aluminide intermetallic alloy. More particularly, the invention is directed to a method of cold forming an aluminide intermetallic alloy in which a viscous medium that provides a moisture resistant barrier is coated on the workpiece.

BACKGROUND OF THE INVENTION

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

Aluminides such as iron aluminides based on $Fe_3Al$ and FeAl as well as aluminides of nickel and titanium are well known to suffer from reduction in ductility, when tested in ambient air as opposed to tested in oxygen. The reduction in ductility is from a hydrogen embrittlement mechanism commonly referred to as "environmental effect" and is considered to result from the following chemical reaction:

$$2Al+3H_2O \rightarrow Al_2O_3+6H$$

The Al from the aluminide, such as in $Fe_3Al$ or FeAl, reacts with moisture in air and forms $Al_2O_3$ with 6 atoms of hydrogen. It is this hydrogen that causes the embrittlement of the alloy. The process of embrittlement is different than in steels in that it is the hydrogen from the surface reaction that causes the embrittlement as opposed to the hydrogen content in steels. One could say that for iron aluminides it is a "dynamic embrittlement" as opposed to "static embrittlement" in steels. Due to the low room temperature ductility of these alloys, processing of an ingot into a thin sheet requires extensive hot working; making powder metallurgy an attractive alternative. However, the deleterious effects of hydrogen embrittlement on ductility can remain even in powder metallurgy processes.

Environmental embrittlement of intermetallic materials is discussed in N. S. Stoloff et al., Eds., "Physical Metallurgy and Processing of Intermetallics Compounds," New York: Chapman and Hall (1996), Chapters 9 & 12, the entire contents of which are herein incorporated by reference. A further discussion of this phenomenon can be found in C. T. Liu, Materials Research Society Symposium Proceedings, Vol. 288, p. 3–19, 1993, the entire contents of which are herein incorporated by reference. However, while Liu reports on various techniques including formation of protective oxides, refinement of grain structure and microalloying, such techniques may not be practical or economical under a variety of manufacturing conditions.

In forming of sheet metal, it is conventional to use lubricants between a die and metal to be formed. See, for example, Metals Handbook Ninth Edition, Volume 14, entitled "Forming and Hot Forging", published by ASM International, Metals Park, Ohio, 1988, the contents of which is hereby incorporated by reference. U.S. Pat. No. 3,969,195, the disclosure of which is herein incorporated by reference, discloses improvements to mechanical forming of materials through the use of auxiliary substances including soaps, pastes, and oils and by the use of coatings of electroplated metals.

From the above, there is a need for processing techniques for aluminide intermetallic alloys that can minimize hydrogen embrittlement while maximizing the ductility properties of the alloy. Additionally, such processing techniques should be relatively inexpensive and accommodate workpieces of various shapes and sizes and processing/forming histories.

SUMMARY OF THE INVENTION

A method of cold fabricating an intermetallic alloy composition, comprising steps of coating an article of an intermetallic alloy composition with a viscous medium which provides a moisture resistant barrier on the surface of the article, fabricating the coated article into a desired shape, and optionally removing the coating from the shaped article. The coating step can be carried out by applying oil to the surface of the article or immersing the article in oil. The intermetallic article can be an iron aluminide and the fabrication step can include stamping, bending, forming, cutting, shearing or punching. During the fabrication step a surface oxide film on the article can be cracked and metal surfaces exposed by the cracked oxide film can be protected from exposure to moisture in the air by the viscous medium.

The article can be made by thermomechanical processing of roll compacted or tape cast intermetallic alloy powder, such as an iron aluminide having, in weight %, 4.0 to 32.0% Al and ≦1% Cr. Other suitable intermetallic alloys include an iron aluminide having, in weight %, ≦32% Al, ≦2% Mo, ≦1% Zr, ≦2% Si, ≦30% Ni, ≦10% Cr, ≦0.3% C, ≦0.5% Y, ≦0.1% B, ≦1% Nb and ≦1% Ta, and an iron aluminide having, in weight %, 20–32% Al, 0.3–0.5% Mo, 0.05–0.3% Zr, 0.01–0.5% C, ≦0.1% B, ≦1% oxide particles.

BRIEF DESCRIPTION OF THE DRAWING FIGURES

Other objects and advantages of the invention will become apparent from the following detailed description of preferred embodiments in connection with the accompanying drawings in which like numerals designate like elements and in which.

DETAILED DESCRIPTION OF PREFERRED EMBODIMENTS

Figure 1:
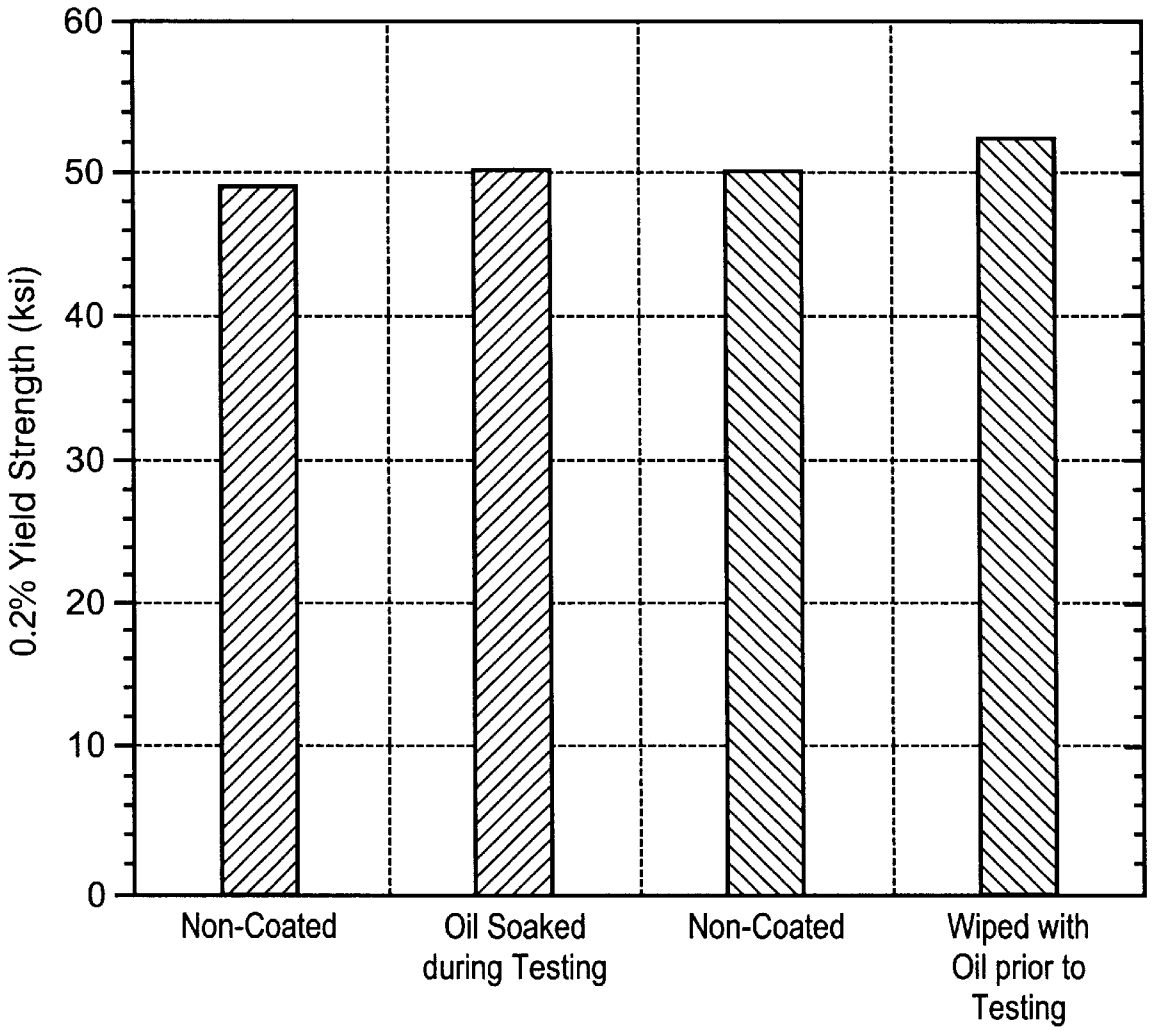
FIG. 1 is a graph of 0.2% yield strength for an iron aluminide sample under various testing conditions.

The invention provides a manufacturing process which addresses the environmental embrittlement problem which hinders fabrication of parts from aluminide intermetallic alloys such as iron aluminides, nickel aluminides and titanium aluminides. The process can be implemented in an easy to use and economical manner as explained herein.

A viscous medium can be applied to the surface of an article of an intermetallic alloy composition to form a barrier between the metal surface and moisture in the environment. The viscous medium, such as oil, provides several desirable features, such as a moisture resistant barrier and providing a coating that accommodates deformation of the article while still providing its coating function. The viscous medium can be used during fabrication processes and removed in the final step. Besides oil and oil based products, other organic liquids can also be used including more environmentally friendly substances that can provide a substantially water impermeable protective coating.

In an exemplary embodiment, FeAl sheets of 8-mil thickness made by tape casting iron aluminide powder (Sample TC) and high shear roll compaction of iron aluminide powder (Samples SC-1 and SC-2) were tested. The iron aluminide powder was a prealloyed powder having, in weight %, 24% Al, about 0.005% B, about 0.40% Mo, about 0.1% Zr, about 0.1% C, ≦1% Cr, balance Fe and impurities. Preferably, the iron aluminide has a B2 ordered structure. Examples of other suitable iron aluminide alloys are given in U.S. Pat. No. 6,030,472, the disclosure of which is herein incorporated by reference.

Other intermetallic alloy compositions which can be processed in accordance with the invention include nickel aluminides and titanium aluminides. One example of an iron aluminide alloy is an alloy having, in weight %, ≦32% Al, ≦2% Mo, ≦1% Zr, ≦2% Si, ≦30% Ni, ≦10% Cr, ≦0.3% C, ≦0.5% Y, ≦0.1% B, ≦1% Nb and ≦1% Ta. A more specific iron aluminide alloy can include, in weight %, 20–32% Al, 0.3–0.5% Mo, 0.05–0.3% Zr, 0.01–0.5% C, ≦0.1% B, ≦1% oxide particles.

The tape cast sample TC was made by tape casting a mixture of 80% gas atomized powder and 20% water atomized powder (−100 mesh+5% to +325 mesh sizes) to form a green body. The high shear roll compacted samples (SC-1 and SC-2) were made by roll compacting water atomized powder (−100 mesh+5% to +325 mesh sizes) into a green body. Subsequent to formation, green bodies were subjected to a heat treatment step to remove volatile components, including the binder, in an inert atmosphere consisting of either nitrogen (or argon atmosphere) at approximately 500° C. (932° F.). The strips were then subjected to primary sintering in a vacuum furnace at 1230° C. (2250° F.). In this first sintering step, the porous brittle de-bindered strips were heated under conditions suitable for effecting at least partial sintering. The sintering step can produce strip with substantial porosity, for example 25–40% by volume porosity. In order to reduce such porosity, the sintered strips were cold rolled to reduce the thickness thereof and thereby increase the density. Subsequent to cold rolling, the strips were annealed in a vacuum furnace in a batch manner at a suitable temperature to relieve stress and/or effect further densification of the powder. The heat treatment and cold rolling steps were repeated until the desired sheet properties, and dimensions are attained. The finished sheet was then tested for mechanical, chemical and electrical properties. The strips were then cut and formed to the desired shape.

The above process should be considered exemplary and it should be understood that in addition to the above, any suitable thermomechanical processing methods can be used. For example, suitable tape casting and roll compacting techniques are discussed in U.S. Pat. No. 6,030,472, the disclosure of which is herein incorporated by reference. Suitable thermomechanical processing methods are discussed in R. E. Mistler, et al.,"Tape Casting as a Fabrication Process for Iron Aluminide (FeAl) Thin Sheet," *Materials Science and Engineering,* Vol. A258, Elsevier, New York, N.Y., 1998, pp.258–265 and F. Rasouli, et al., "Tape Casting of Iron Aluminide Powders," *Procd. International Conference on Powder Metallurgy & Particulate Materials,* Vol 9, compiled by H. Ferguson and D. T. Whychell, Metal Powder Industries Federation, New York, N.Y., 2000, pp. 131–140, the contents of each are herein incorporated by reference.

Additional examples of suitable processing steps include melting the aluminide and casting into a desired shape followed by thermomechanical processing of the casting into an article of desired shape. Such processing can include cold rolling a sheet of FeAl and forming the cold rolled sheet into an electrical resistance heating element, the electrical resistance heating element being capable of heating to 900° C. in less than 1 second when a voltage up to 10 volts and up to 6 amps is passed through the heating element. Other processing steps for forming iron aluminides into electrical resistance heating elements can be found in U.S. Pat. Nos. 5,620,651 and 5,976,458, the disclosures of which are incorporated herein by reference.

In each case, the stamped specimens were given a 2 hour stress relief anneal at 700° C. in vacuum. Tensile tests were carried out in air and after application of oil. The oil chosen was a standard mineral oil and was applied in two different ways. In the first case, the oil was applied to the specimen surface and wiped off to just leave a very thin film. In the second case, oil soaked the specimen during testing. This was done by wrapping a tissue soaked in oil around the specimen. Alternatively, the specimen or workpiece could be immersed in oil either before or during further fabricating steps such as shaping, bending, cutting, shearing, or punching.

Room temperature tensile data at a strain rate of 0.2/min is shown in Tables 1 and 2 for samples in air and after oil application. Samples 3L and 4L in Table 1 and 4L and 5L in Table 2 were oil coated prior to testing.

TABLE 1

| | | | Sample TC | | | | | |
|---|---|---|---|---|---|---|---|---|
| Specification No. | Test Temp (° C.) | Final Heat Treatment | Yield Strength (ksi) | Tensile Strength (ksi) | Total Elongation (%) | Red. of Area (%) | Resistivity (μohm-cm) Before Treatment | Resistivity (μohm-cm) After Treatment |
| 1L | 23 | 700° C./2 h Vac. | 45.64 | 66.87 | 3.90 | 8.21 | 136.90 | 135.20 |
| 2L | 23 | 700° C./2 h Vac. | 48.77 | 66.33 | 3.10 | 10.73 | 137.20 | 134.10 |

TABLE 1-continued

| Sample TC | | | | | | | | |
|---|---|---|---|---|---|---|---|---|
| Specification No. | Test Temp (° C.) | Final Heat Treatment | Yield Strength (ksi) | Tensile Strength (ksi) | Total Elongation (%) | Red. of Area (%) | Resistivity (μohm-cm) Before Treatment | Resistivity (μohm-cm) After Treatment |
| 3L | 23 | 700° C./2 h Vac. oil coated | 48.10 | 71.58 | 4.50 | 12.61 | — | — |
| 4L | 23 | 700° C./2 h Vac. oil coated | 47.90 | 83.01 | 5.98 | 12.95 | — | — |

TABLE 2

| Samples SC-1 and SC-2 | | | | | | | | |
|---|---|---|---|---|---|---|---|---|
| Specification No. | Test Temp (° C.) | Final Heat Treatment | Yield Strength (ksi) | Tensile Strength (ksi) | Total Elongation (%) | Red. of Area (%) | Resistivity (μohm-cm) Before Treatment | Resistivity (μohm-cm) After Treatment |
| 1L | 23 | 700° C./2 h Vac. | 50.08 | 92.61 | 5.80 | 14.39 | 134.90 | 136.90 |
| 2L | 23 | 700° C./2 h Vac. | 50.49 | 84.72 | 4.66 | 13.31 | 137.00 | 139.00 |
| 3L | 23 | 700° C./2 h Vac. | 50.34 | 87.43 | 4.16 | 12.72 | 137.80 | 135.50 |
| 4L | 23 | 700° C./2 h Vac. oil coated. | 52.62 | 113.78 | 9.50 | 18.39 | — | — |
| 5L | 23 | 700° C./2 h Vac. oil coated | 53.19 | 105.53 | 7.64 | 14.53 | — | — |

Several observations can be made from these results. The yield strength of sheet specimens tested in air and oil were essentially the same. This result is consistent with published data and is not surprising in that the 0.2% offset yield point is the first occurrence of plastic deformation, where the surface oxide film of $Al_2O_3$ will most likely break. Deformation at stress levels below the yield stress is elastic and is determined by the state of stress and the elastic moduli, which are not expected to be influenced by a surface oil film. Beyond the yield stress plastic deformation can change the surface area, leading to the exposure of fresh material at the specimen surface. Aluminum oxide surface films which were protecting the surface from environmental attack below the yield stress are now broken, allowing attack of the exposed surface underneath the oxide surface films.

The processing technique according to the invention allows the aluminide article surface to be protected from environmental attack when plastic deformation begins. Reviewing the total elongation data for sheet specimens tested with oil coatings, it can be seen that total elongation is significantly higher than for specimens tested in air. For samples SC-1 and SC-2 the total elongation values are 1½ to 2 times higher for oil coated specimens as opposed to uncoated specimens. For tape cast material (sample TC), the total elongation values were lower than the values for samples SC-1 and SC-2 but higher than the values for the uncoated specimens, e.g., increased by nearly 1½ times. It is believed that the oil film protects the freshly exposed aluminum from water vapor in the air. Prevention of environmental embrittlement in this way allows the material to deform to a greater extent during manufacturing steps. The ultimate tensile strength of specimens coated with oil is superior to that of the strips without the oil coating. The ultimate tensile strength values are nearly 20–25% higher for oil coated specimens as compared to uncoated specimens.

Figure 2:
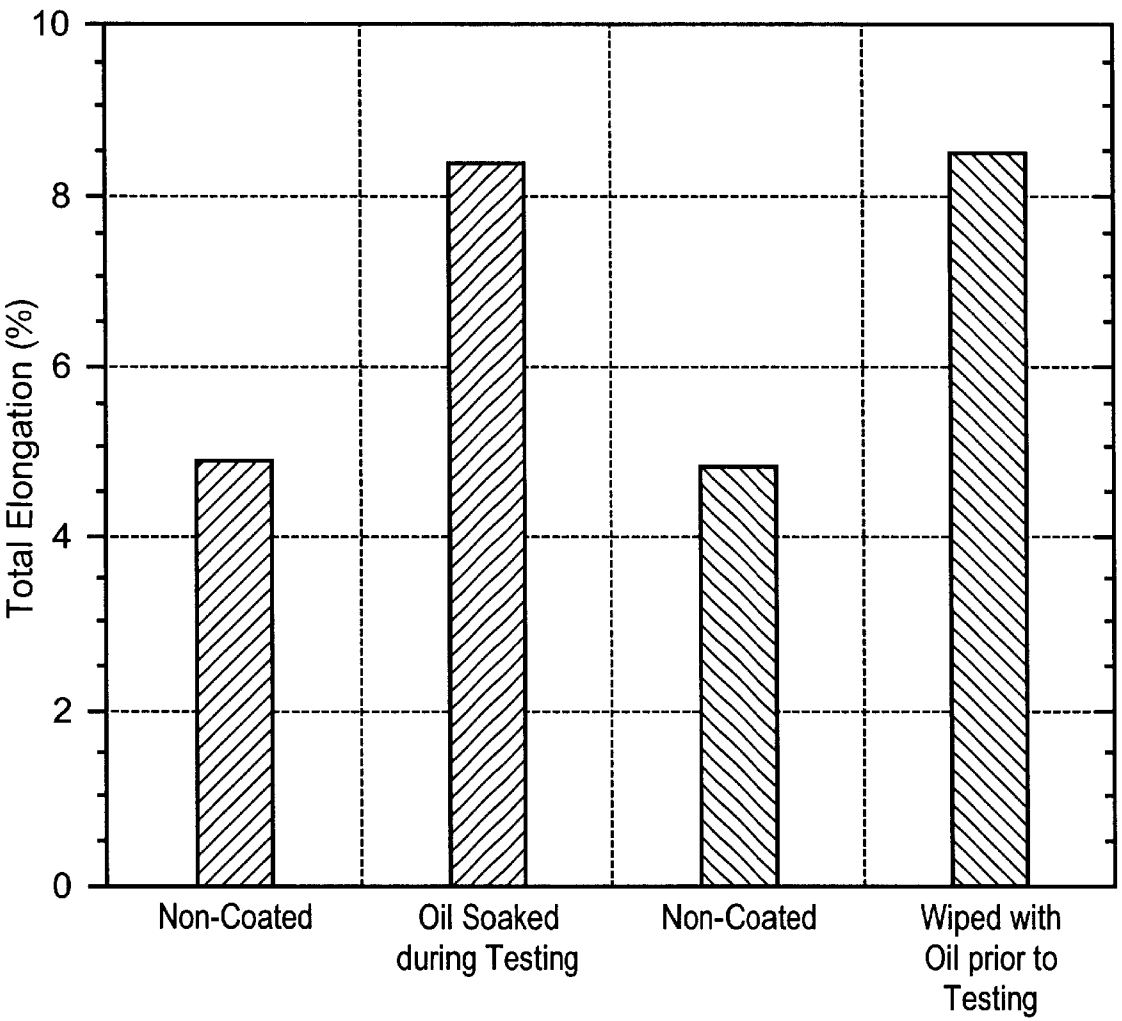
FIG. 2 is a graph of total elongation for an iron aluminide sample under various testing conditions.
Figure 3:
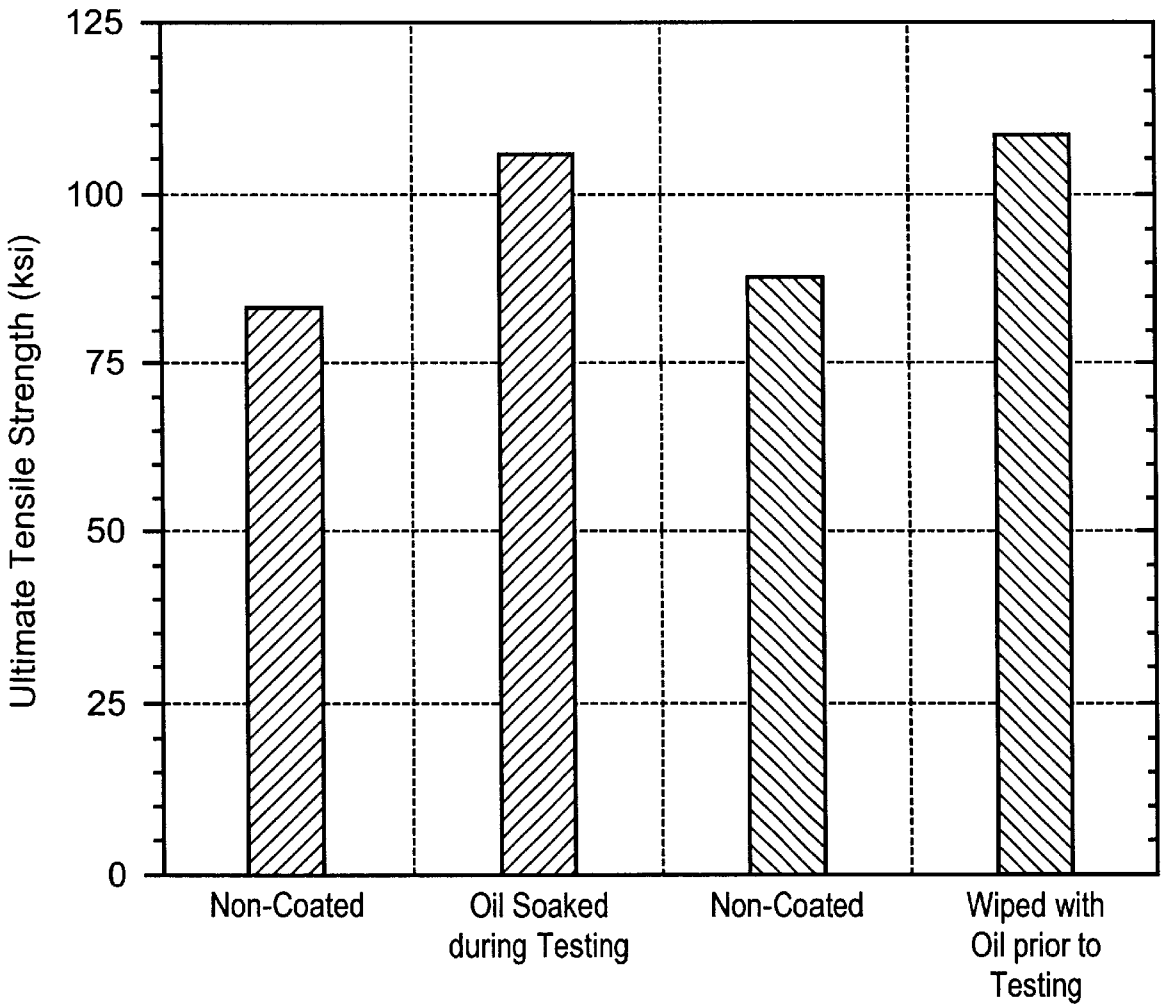
FIG. 3 is a graph of ultimate tensile strength for an iron aluminide sample under various testing conditions.

Results from the test data indicate that both soaking in oil and a very thin film on the surface that forms by the wiping process can provide improvement in the measured mechanical properties. For example, FIGS. 1–3 indicate that the average 0.2% yield strength of specimens with and without oil coating is essentially the same, but the elongation and ultimate tensile strength for iron aluminide samples can generally be improved over uncoated samples by both soaking the test specimen in oil during the testing procedure and by wiping the samples with oil prior to testing.

A second series of tests was conducted using sheets that had been prepared by the roll compaction method. The sheets were stress relieved and coated with Mobil 635™ gear oil. The procedure for these tests was slightly different from that for the samples described above. The test specimens were formed to the dimensions of the pin-loaded tension test specimen having a two inch gauge length (as described in ASTM E8). Strain was measured with an extensometer (Model: 2630-115-Instron, Inc., Canton, Mass.) over the two inch gauge length, and percent elongation was calculated from the plastic strain to failure measured by the extensometer. The practice was to first coat the gauge section with oil, and wrap an oil soaked piece of paper towel around the gauge section. Then, a square of oil soaked paper towel was placed on each side of the tabs at each end of the test piece, before gripping the tabs in the testing machine jaws. This ensured the sample remained oil covered and that the failure did not occur first in the tabs.

Figure 4:
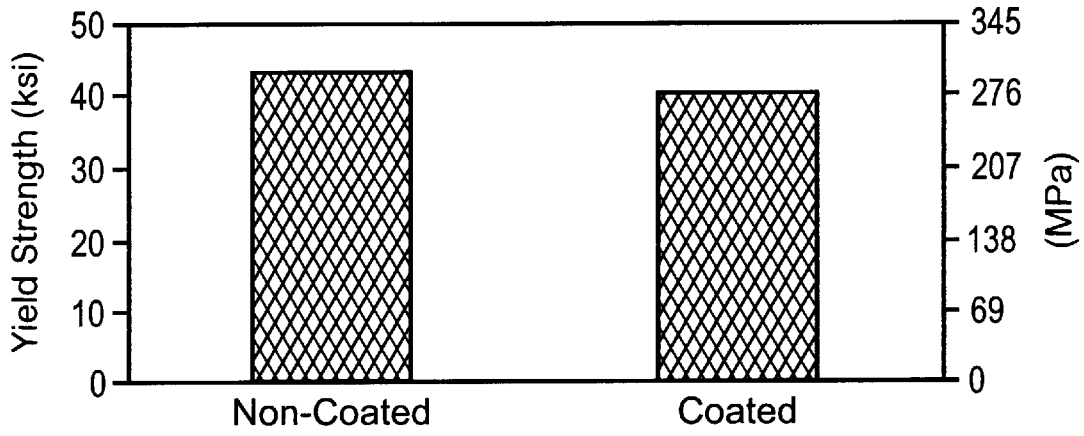
FIG. 4 is a graph of average yield strength for coated and non-coated samples.
Figure 5:
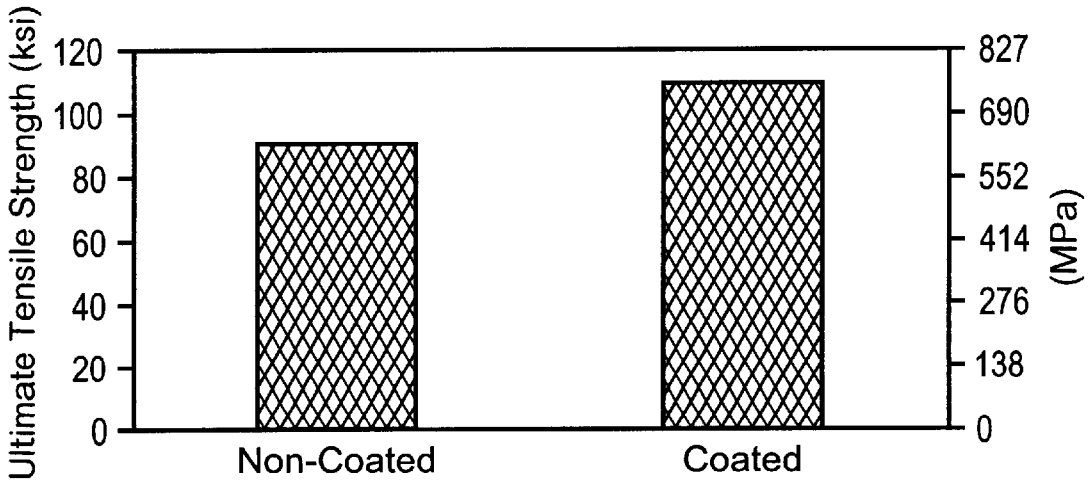
FIG. 5 is a graph of average ultimate tensile strength for coated and non-coated samples.
Figure 6:
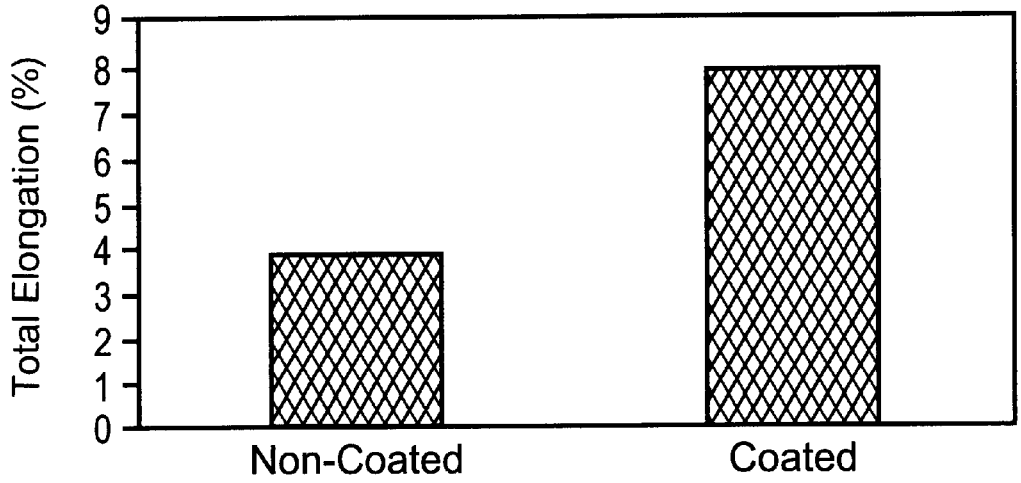
FIG. 6 is a graph of average total elongation for coated and non-coated samples.

The average yield strength, ultimate tensile strength and percent elongation values from triplicate tests are shown in FIGS. 4 through 6. The data was consistent with the results of the first series. In comparison to non-coated samples, the oil coating had little or no effect on the yield strength, but increased the tensile strength by approximately 20% and approximately doubled the total percent elongation.

Figure 7:
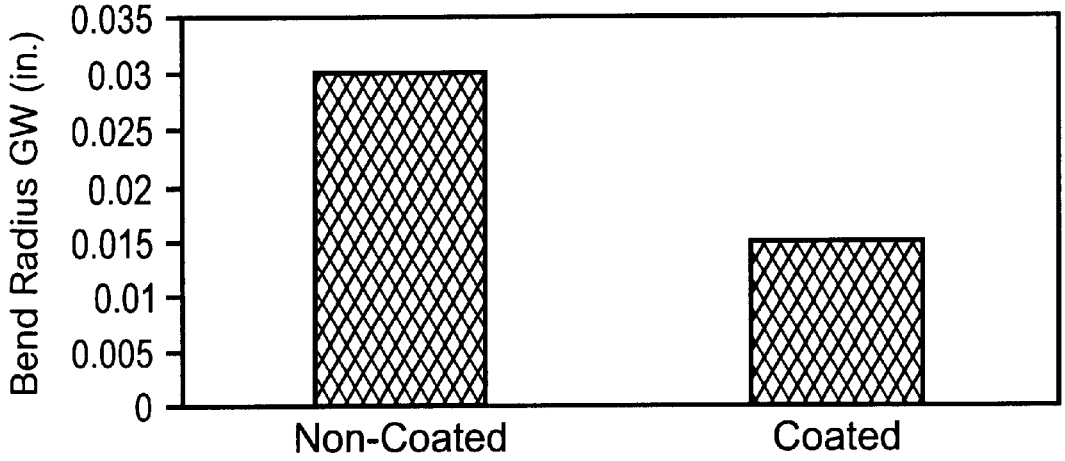
FIG. 7 is a graphical comparison of good way bend tests.

A 90° bend test, such as that described in ASTM B-820, was conducted on test coupons of iron aluminide to characterize the formability. Testing for each bend radius included four samples, and in all cases the pass criterion was 3 out of 4 samples (75%) with no cracks visible at 10 X magnification. The minimum good way ("GW") bend radii (GW being defined as bending in the rolling direction) around which a sample can be bent without cracking for oil-coated and non-coated strips of roll compacted production material are shown in FIG. 7. The results show the improvement in bend when oil is used (only the center region away from the edges is examined after the bend for rating the bend).

Bend tests were also conducted in which a sample was then bent in the bad way ("BW") orientation (BW being defined as bending in a transverse direction, which is perpendicular to the rolling direction). Tensile data and bend data are shown in Tables 3 and 4 for roll compacted samples (RC). In Table 3, Table A is data for GW bending and Table B is data for BW bending. In Table 4, data is presented for samples sheared and bend tested with an oil coating and for a control group in which the sample was sheared and tested without the use of oil coatings, i.e., dry.

To investigate whether oil coating can also eliminate microscopic edge cracks that can be found in conventional dry shear samples, the shear device was placed in a large pan containing oil. The level of the oil in the pan was such as to cover the blade during the shearing operation. This ensured the sample remained oil covered during the shearing operation. After shearing, the test pieces were soaked in oil and the bend radii were measured. As shown in Table 4, the oil sheared/oil bent samples fail at a much smaller radius (0.02 in. for an oil coated vs. 0.03 in. for a non-coated sample), and there was no visual sign of edge cracks.

Microscopic analyses were performed to follow the progress of fracture. The fracture typically starts with cracks generated at edges, which then propagate inwards. As the bend limit of the material is approached the surface of the sample deforms revealing individual grains and developing a texture resembling an orange peel. Some cracks may start to form at grain boundaries. The extent of crack propagation is inversely proportional to the bend radius of the "V" punch used for the bend test. Additionally microscopic cracks induced in the sample, particularly at edges, during primary operations (e.g. shearing, cutting, etc.) lead to accelerated failure during the bend test. However, these kinds of initial cracks due to primary operations can potentially be reduced through the use of alternative methods (e.g. etching, electrical discharge machining, etc).

Drawing tests were run with and without oil in which a 0.875 inch diameter hardened steel ball was pressed into the surface of a strip. The opposite surface of the strip was constrained with a die having a circular opening corresponding to the steel ball. In this way a small cup is drawn. The test measures the height to which the cup can be drawn before failure of the strip occurs. For the oil test, the strip was coated in oil on both surfaces and a thin sheet of polyethylene was placed on each surface to maintain the oil film. The oil was allowed to impregnate the porous structure of the sintered material before the test was run. The cup was drawn with the polyethylene in place.

Tables 5 and 6 summarize the results from the drawing test on non-coated samples and samples coated with oil and utilizing a polyethylene sheet. Table 5 are results from a finished (fully processed) FeAl strip and Table 6 are results from an as-sintered (partially processed) FeAl strip. The results show that for a 0.008 inch thick finished strip in the

TABLE 3

| | Sample RC | | | | | | | | | |
|---|---|---|---|---|---|---|---|---|---|---|
| | 0.040" punch | | 0.030" punch | | 0.025" punch | | 0.020" punch | | 0.015" punch | |
| Sample/test condition | Number passing | Number failing | Number passing | Number failing | Number passing | Number failing | Number passing | Number failing | Number passing | Number failing |
| | | | A (GW) | | | | | | | |
| Standard - stress relief, dry shear coupon, test | — | — | 3 | 1 | 0 | 3 | — | — | — | — |
| Standard but additional stress relief after shearing | 3 | 0 | 3 | 1 | 0 | 3 | — | — | — | — |
| Standard but additional final anneal after shearing | 3 | 0 | 0 | 3 | 0 | 2 | — | — | — | — |
| Stress relief, cut under oil, bent in air, oil film present | 2 | 0 | 3 | 1 | 1 | 3 | 0 | 2 | — | — |
| Stress relief, cut under oil, bent under oil | — | — | — | — | 3 | 0 | 3 | 1 | 0 | 3 |
| | | | B (BW) | | | | | | | |
| Standard - stress relief, dry shear coupon, test | 3 | 0 | 0 | 3 | — | — | — | — | — | — |
| Standard but additional stress relief after shearing | 3 | 0 | 0 | 3 | — | — | — | — | — | — |
| Standard but additional final anneal after shearing | 3 | 0 | 0 | 3 | 0 | 2 | — | — | — | — |
| Stress relief, cut under oil, bent in air, oil film present | 2 | 0 | 3 | 0 | 2 | 2 | 0 | 2 | — | — |
| Stress relief, cut under oil, bent under oil | — | — | — | — | 3 | 0 | 0 | 2 | — | — |

TABLE 4

| | Sample RC | | | | | |
|---|---|---|---|---|---|---|
| | Oil Shear, Oil Bend | | | Dry Shear, Dry Bend | | |
| Row Number | Bend Radius (in.) | Good way | Bad way | Bend Radius (in.) | Good way | Bad way |
| 1 | 0.03 | | pass | 0.04 | | pass |
| 2 | 0.03 | | pass | 0.04 | | pass |
| 3 | 0.03 | | pass | 0.04 | | pass |
| 4 | 0.03 | pass | | 0.04 | pass | |
| 5 | 0.03 | pass | | 0.04 | pass | |
| 6 | 0.03 | pass | | 0.04 | pass | |
| 7 | 0.025 | | pass | 0.04 | pass | |
| 8 | 0.025 | | pass | 0.03 | | fail |
| 9 | 0.025 | | pass | 0.03 | | fail |
| 10 | 0.025 | pass | | 0.03 | | fail |
| 11 | 0.025 | pass | | 0.03 | fail | |
| 12 | 0.025 | pass | | 0.03 | fail | |
| 13 | 0.02 | | fail | 0.03 | pass | |
| 14 | 0.02 | | fail | 0.03 | fail | |
| 15 | 0.02 | | fail | — | | |
| 16 | 0.02 | fail | | — | | |
| 17 | 0.02 | pass | | — | | |
| 18 | 0.02 | fail | | — | | |
| 19 | 0.02 | fail | | — | | |

stress relieved condition, the cup height is approximately doubled in the presence of oil. In the case of an as-sintered strip the cup height is tripled.

TABLE 5

Draw Test on Finished (Fully Processed) FeAl Strip

| Sample No. | Displacement (in.) Dry | Oil Coated |
|---|---|---|
| 1 | 0.1 | 0.206 |
| 2 | 0.088 | 0.205 |
| 3 | 0.091 | 0.158 |
| 4 | 0.094 | 0.198 |
| 5 | 0.095 | 0.198 |
| 6 | 0.091 | 0.191 |
| 7 | 0.093 | 0.203 |
| Average | 0.093 | 0.194 |

TABLE 6

Draw Test on As-Sintered (Partially Processed) FeAl Strip

| Sample No. | Displacement (in.) Dry | Oil Coated |
|---|---|---|
| 1 | 0.01 | 0.02 |
| 2 | 0.005 | 0.018 |
| 3 | 0.008 | 0.02 |
| 4 | 0.005 | 0.02 |
| 5 | 0.005 | 0.02 |
| Average | 0.006 | 0.02 |

To establish that the improvement in drawability observed in the tests reported by the data in Tables 5 and 6 was not simply the result of lubrication by the plastic, a draw test was repeated by placing thin sheets of polyethylene on both sides of a sintered FeAl strip without the use of an oil coating. Substantially no differences in the drawability between unwrapped and wrapped pieces with polyethylene were observed indicating that polyethylene film which can act as a lubricant does not prevent moisture from reaching the deformed surface and that the oil-type coating provides improved results. The results are summarized in Table 7.

TABLE 7

Draw Test on Non-Coated Finished (Fully Processed) FeAl Strip with Polyethylene Wrap

| Sample No. | Displacement (in.) Dry | Dry + Plastic | Oil Coated + Plastic |
|---|---|---|---|
| 1 | 0.1 | 0.093 | 0.206 |
| 2 | 0.088 | 0.087 | 0.205 |
| 3 | 0.091 | 0.093 | 0.158 |
| 4 | 0.094 | 0.074 | 0.198 |
| 5 | 0.095 | 0.09 | 0.198 |
| 6 | 0.091 | 0.088 | 0.191 |
| 7 | 0.093 | 0.097 | 0.203 |
| Average | 0.093 | 0.089 | 0.194 |

The results indicate that coating of an aluminide article with a viscous medium can improve fabricability of the article especially during forming and shearing operations. The aluminide article can be coated with oil, wax, paste, gel or other suitable viscous medium which provides a water impermeable layer or by immersing the article in oil or other suitable liquid. As a result, stamping (cutting), forming (bending), drawing, or other operations (e.g., shear device, forming device, etc. . . . ) related to the fabrication of aluminide intermetallic alloys can be significantly improved, especially for articles such as sheet of iron aluminide. Results of this study can be directly applicable to FeAl fabrication processes, where the fabricating step forms the article in an ambient air environment such that a surface oxide film on the article is cracked and underlying metal surfaces are exposed to moisture in the air unless protected by the viscous medium. The oil film can minimize cracking during fabrication processes by not exposing fabricated surfaces to moisture in air. Iron aluminides are susceptible to environmental embrittlement of exposed surfaces created by breakup of oxide films during the fabrication process. As an example, an aluminide sheet to be fabricated can be coated with a viscous medium such as oil during the fabricating step, e.g., immersing the sheet in oil prior to stamping and forming operations.

Although the present invention has been described in connection with exemplary embodiments thereof, it will be appreciated by those skilled in the art that additions, deletions, modifications, and substitutions not specifically described may be made without departing from the spirit and scope of the invention as defined in the appended claims.

What is claimed is:

1. A method of cold forming an aluminide intermetallic alloy composition, comprising steps of:

coating an article of an intermetallic alloy composition with a viscous medium providing a moisture resistant barrier on the surface of the article;

fabricating the coated article into a desired shape by stamping, bending, punching, or drawing; and optionally removing the coating from the shaped article.

2. The method of claim 1, wherein the intermetallic alloy is an iron aluminide alloy of the FeAl type.

3. The method of claim 1, wherein the coating step comprises applying oil to the surface of the article or immersing the article in oil.

4. The method of claim 1, wherein the article comprises a sheet and the fabricating step comprises stamping, bending, or drawing the sheet into the desired shape.

5. The method of claim 1, wherein the article is made by thermomechanically processing a casting of the intermetallic alloy composition.

6. The method of claim 1, wherein the article is made from a powder of the intermetallic alloy composition.

7. The method of claim 1, wherein the intermetallic alloy comprises an iron aluminide having, in weight %, 4.0 to 32.0% Al and ≦1% Cr.

8. The method of claim 7, wherein the iron aluminide has a B2 ordered structure.

9. The method of claim 1, wherein the article is a cold rolled sheet of FeAl.

10. The method of claim 9, further comprising a step of forming the cold rolled sheet into an electrical resistance heating element, the electrical resistance heating element being capable of heating to 900° C. in less than 1 second when a voltage up to 10 volts and up to 6 amps is passed through the heating element.

11. The method of claim 1, wherein the intermetallic alloy comprises an iron aluminide having, in weight %, 32% Al, ≦2% Mo, ≦1% Zr, ≦2% Si, ≦30% Ni, ≦10% Cr, ≦0.3% C, ≦0.5% Y, ≦0.1% B, ≦1% Nb and ≦1% Ta.

12. The method of claim 1, wherein the intermetallic alloy comprises an iron aluminide having, in weight %, 20–32% Al, 0.3–0.5% Mo, 0.05–0.3% Zr, 0.01–0.5% C, ≦0.1% B, ≦1% oxide particles.

13. The method of claim 1, wherein the article is made by tape casting an intermetallic alloy powder and thermomechanically processing the powder.

14. The method of claim 1, wherein the article is made by roll compacting an intermetallic alloy powder and thermomechanically processing the powder.

15. The method of claim 1, wherein the fabricating step comprises forming the article in an ambient air environment such that a surface oxide film on the article is cracked and underlying metal surfaces are protected from exposure to moisture in the air by the viscous medium.

16. The method of claim 1, wherein the fabricating step comprises cold forming the article into a desired shape in an air environment at ambient temperature.

17. The method of claim 1, wherein the fabricating step comprises forming the article in sheet form into a stamped sheet product.

18. An article produced by the method of claim 1.

19. The method of claim 1, wherein the coated article is fabricated into the desired shape by stamping.

20. The method of claim 1, wherein the coated article is fabricated into the desired shape by bending.

21. The method of claim 1, wherein the coated article is fabricated into the desired shape by punching.

22. The method of claim 1, wherein the coated article is fabricated into the desired shape by drawing.

* * * * *